US008186500B2

(12) United States Patent
Brunnhuber et al.

(10) Patent No.: US 8,186,500 B2
(45) Date of Patent: May 29, 2012

(54) MACHINE FOR HANDLING FLAT ARTICLES

(75) Inventors: Werner Brunnhuber, Sauerlach (DE); Martin Lasinger, Sauerlach (DE); Robert Stahl, Munich (DE)

(73) Assignee: Neopost Technologies, Bagneux (FR)

( * ) Notice: Subject to any disclaimer, the term of this patent is extended or adjusted under 35 U.S.C. 154(b) by 191 days.

(21) Appl. No.: 12/695,761

(22) Filed: Jan. 28, 2010

(65) Prior Publication Data

US 2010/0213034 A1 Aug. 26, 2010

(30) Foreign Application Priority Data

Jan. 30, 2009 (EP) ..... 09305094

(51) Int. Cl.
*B65G 19/00* (2006.01)

(52) U.S. Cl. ..... 198/728; 198/727; 198/835; 271/34

(58) Field of Classification Search ..... 198/717, 198/721, 727, 728, 836.1, 837, 850, 832, 198/835; 271/13, 34, 275
See application file for complete search history.

(56) References Cited

U.S. PATENT DOCUMENTS

| | | | | |
|---|---|---|---|---|
| 2,925,926 | A * | 2/1960 | Packman et al. | 198/836.1 |
| 6,695,135 | B1 * | 2/2004 | Lapeyre | 198/853 |
| 7,424,948 | B2 * | 9/2008 | Mol | 198/832 |
| 7,954,630 | B2 * | 6/2011 | Williams | 198/731 |
| 2004/0255747 | A1 | 12/2004 | Stitz | |
| 2007/0175737 | A1 * | 8/2007 | Honeycutt et al. | 198/835 |

FOREIGN PATENT DOCUMENTS

| | | | |
|---|---|---|---|
| DE | 29813546 | U1 | 1/1999 |
| EP | 0645327 | A1 | 3/1995 |
| WO | 95/18054 | A1 | 7/1995 |
| WO | 03/016187 | A1 | 2/2003 |

* cited by examiner

*Primary Examiner* — James R Bidwell
(74) *Attorney, Agent, or Firm* — Sughrue Mion, PLLC

(57) ABSTRACT

In a mail-handling machine having a conveyor path for conveying the mailpieces, which path is defined by a longitudinal referencing wall and by a top referencing wall, there is provided a conveyor and jogger belt formed of a continuous strip having two opposite faces, namely an inside face provided with a set of teeth suitable for cooperating with drive cogs for driving the belt, and an outside face provided with a plurality of flexible blades spaced apart at a predetermined distance, the free ends of the flexible blades providing both support for the flat articles while they are being conveyed and also jogging for jogging them against the top referencing wall.

12 Claims, 1 Drawing Sheet

MACHINE FOR HANDLING FLAT ARTICLES

TECHNICAL FIELD

The present invention relates in particular to the field of mail handling and it relates more particularly to a machine for handling flat articles, typically mailpieces, which machine is provided with means making it possible to jog said flat articles against the various referencing walls of said machine.

PRIOR ART

Mailpiece conveyor devices implemented in mail-handling machines are well known. Such a mailpiece conveyor device is conventionally made up of a plurality of drive devices such as conveyor rollers (wheels) or conveyor belts that pass through a mailpiece-receiving deck and that are controlled by a suitable drive mechanism for the purpose of conveying said articles downstream along a conveyor path. Such a conveyor device is to be found at various stations of the mail-handling machine.

The sole function of such drive members, in particular of motor-driven conveyor belts, is to convey mailpieces along the conveyor path of the mail-handling machine. Furthermore, since the belts are smooth, slippage often occurs that can give rise to a conveying error or to the mailpieces being skewed.

In seeking to solve that problem of slippage, the inventors have discovered that by modifying the structure of standard smooth belts, they could, in addition to solving that problem, provide an additional and novel function of jogging the mailpieces against the referencing walls of the mail-handling machine, both vertically and longitudinally.

OBJECT AND DEFINITION OF THE INVENTION

An object of the invention is thus to provide a machine for handling mail, and more generally for handling flat articles, in which machine the conveyor belts are improved to overcome slippage and also to jog the mailpieces against the referencing walls of the machine.

This object is achieved with a machine for handling flat articles, which machine has a longitudinal referencing wall, wherein said machine is provided with a conveyor and jogger belt formed of a continuous strip having two opposite faces, namely an inside face provided with a set of teeth suitable for co-operating with drive cogs for driving said belt, and an outside face provided with a plurality of flexible blades spaced apart at a predetermined distance, the free ends of said flexible blades providing supports for said flat articles while they are being conveyed.

When the machine further has a top referencing wall, said free ends of said flexible blades also jog said flat articles against said top referencing wall.

Thus, by means of this simple structure, said flat articles that are typically mailpieces are no longer in direct contact with a rigid drive strip, but rather they are in contact with the flexible ends that provide both a slip-free conveyor function and also a jogging function for jogging against a top reference wall.

In a particular embodiment also making it possible to jog said mailpieces against said longitudinal reference wall, said flexible blades are inclined at a determined angle $\theta$.

Preferably, the "footprint" of said inclined flexible blade on said belt is no greater than the width of a tooth of said set of teeth.

Depending on the embodiment, said belt may be made integrally of a single material such as rubber or silicone, or it may be made up of two portions, said continuous strip that is provided with the set of teeth being made of a first material and said flexible blades being made of a second material that is different from the first material.

Said second material is a material satisfying the technical specifications for conveying said flat articles, e.g. polyurethane.

Advantageously, said flexible blades are fastened to the outside face of said continuous strip whose inside face is provided with said set of teeth by an adhesive or by any fastening means appropriate for the types of the materials used.

Preferably, each of said flexible blades is mounted in register with a tooth of said set of teeth.

BRIEF DESCRIPTION OF THE DRAWING

The invention can be understood more clearly in the light of the following description accompanied by illustrative and non-limiting examples given with reference to the following figures, in which.

DETAILED DESCRIPTION OF EMBODIMENTS

Figure 4:
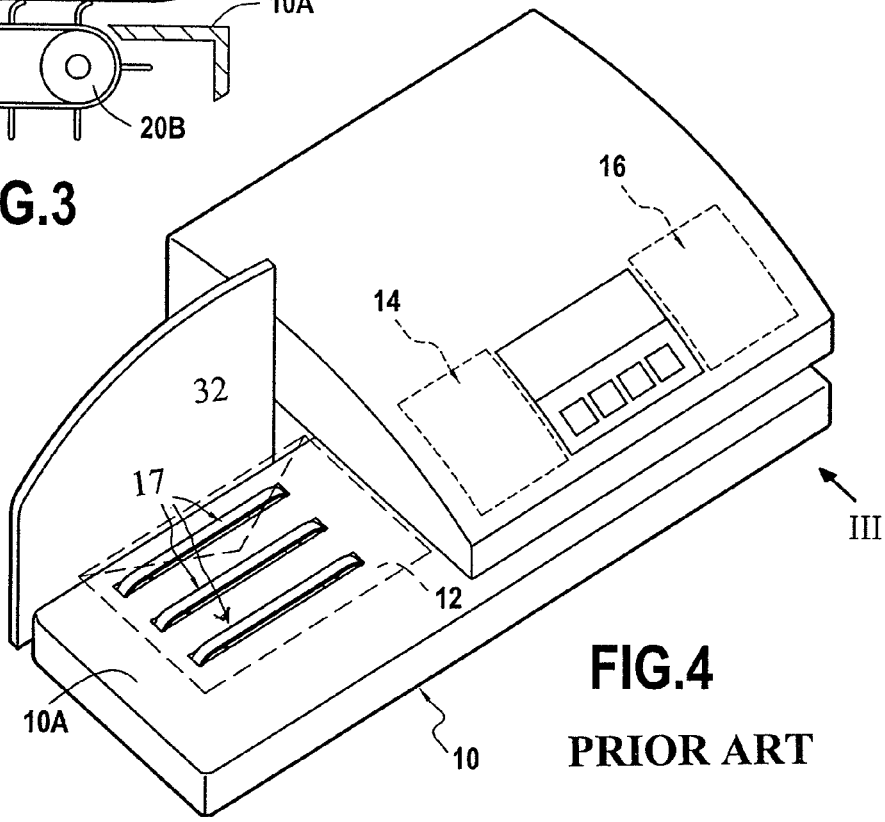
FIG.4 PRIOR ART
FIG. 4 is a perspective view of a prior art mail-handling machine.

FIG. 4 shows an embodiment of a prior art mail-handling machine. Going from upstream to downstream (relative to the direction of movement of the mailpieces through the machine), that machine conventionally comprises at least: a mailpiece feed station 10 provided with a mailpiece-receiving deck 10A on which the mailpieces 12 to be printed are placed in a stack that is compact, and that is uniform or non-uniform (depending on whether or not the mailpieces are of the same size); a selector station 14 for extracting the mailpieces to be printed one-by-one from the bottom of the stack; and a print station 16 for printing a postal imprint on the mailpiece selected in this way.

Depending on its degree of sophistication, that machine can also, for example, incorporate a weigh station for weighing the mailpieces, and, downstream, a station for receiving the franked mailpieces.

More particularly, the feed station 10 is conventionally made up of a plurality of drive members, e.g. three parallel and motor-driven belts 17 as shown, passing through the mailpiece-receiving deck 10A and controlled by a suitable drive mechanism (not shown) for the purpose of conveying the mailpieces downstream along a mailpiece conveyor path passing through said machine. Like drive members are also present all the way along the conveyor path for conveying said mailpieces, and in particular upstream from the print station 16.

Figure 1:
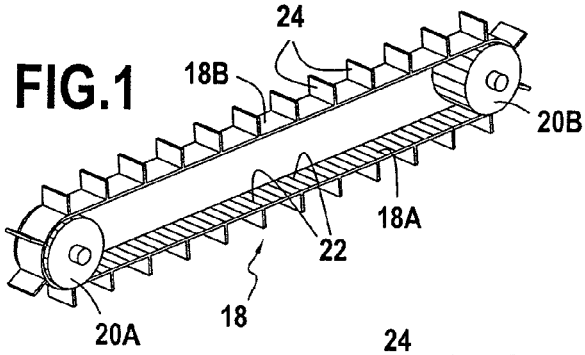
FIG. 1 is a perspective view of a first embodiment of a conveyor belt forming a jogger device of the invention.

In the invention, and as shown in FIG. 1, each of the belts 18 that is designed to be mounted on two motor-driven cogs 20A, 20B making it possible to drive the belt, regardless of its position in the mail-handling machine, is constituted by a continuous strip having two opposite faces, each of which has a distinct structure. The first face, or inside face 18A, in direct engagement with said cogs, is provided with a set of teeth 22 suitable for ensuring that the cogs and the belt are coupled together strongly enough to guarantee slip-free drive. The second face, or outside face 18B, is provided with a plurality of flexible blades 24 that are spaced apart at a predetermined distance that is adapted to accommodate the formats of the mailpieces being handled, e.g. 50 millimeters (mm) for mailpieces of the standard formats C5/C6 and DL. The free end of each of the blades constitutes a support portion for supporting the mailpieces that rest on said blades while they are being conveyed, while also simultaneously performing a jogging function for jogging the mailpieces against a top referencing wall. More particularly, the distance between two adjacent blades is determined to guarantee that at least a minimum of three of the free ends of said blades are in contact with the mailpiece. There is no maximum limit and, in the extreme, it is possible for said blades to be almost side-by-side and then constituted by brushes formed by adjacent tufts of bristles.

Figure 1A:
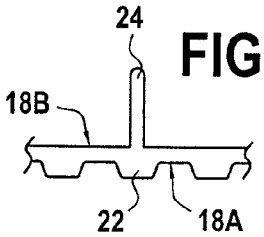
FIG. 1A is a detail view of the belt of FIG. 1.

Preferably, and as shown in FIG. 1A, each of the flexible blades 24 is mounted in register with a tooth of the set of teeth so as to impart improved rigidity to the belt. The thickness and the height of the blades depend essentially on the formats and on the thicknesses of the mailpieces being conveyed and, for standard formats of mailpiece, are, for example, respectively 2 mm and 20 mm.

Conventionally, the belt is made integrally in one extruded piece of a single material such as rubber or silicone, the level of flexibility of the blades then depending on their height and their thickness. However, said flexible blades may also be made of a material different from the material of which the toothed portion of the strip is made, e.g. a polyurethane, and then be chosen specifically as a function of the drive technical specifications (friction, abrasion, hardness, elasticity) required for the conveying of the mailpieces. In this configuration, the flexible blades are then fastened to the outside face of the toothed strip by an adhesive or by any other fastening means appropriate for the types of the materials used.

Thus, with the invention, the mailpieces are no longer in contact with a strip that is smooth and that is relatively rigid due to it being necessary for it to be coupled to the motor-driven cogs, but rather they are in contact with a more flexible support made up of flexible blades that, by improved grip, make it possible to avoid any slippage of the mailpieces while they are being conveyed. In addition, and above all, this flexibility makes it possible to procure vertical jogging against the top referencing wall 30 of the mail-handling machine and thus to procure better compensation for thickness variations, as explained in more detail below with reference to FIG. 3.

Figure 2A:
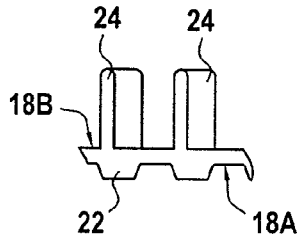
FIGS. 2A and 2B are detail views of a second embodiment of a conveyor belt forming a jogger device of the invention.
Figure 2B:
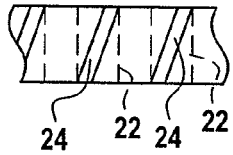

FIGS. 2A and 2B show another embodiment of the conveyor and jogger belt in which the flexible blades 24 are no longer straight (i.e. perpendicular to the direction in which the belt advances) but rather they are inclined at a determined angle θ relative to said perpendicular direction, e.g. at an angle of 30° thereto, so as also to provide a function of jogging against the longitudinal referencing wall 32. Preferably, the "footprint" of the blade inclined in this way on the belt is no greater than the width of one tooth of the set of teeth, so as to preserve sufficient rigidity for the belt as it goes round.

Figure 3:
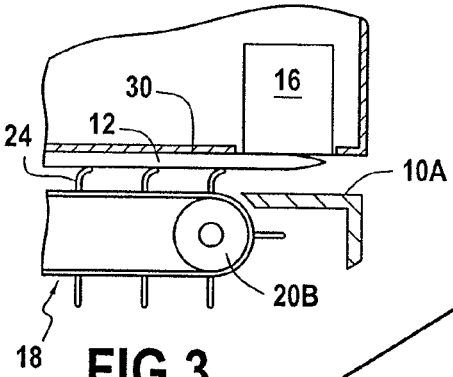
FIG. 3 is a fragmentary section view at the print means of the jogger device of the invention.

The vertical jogging function provided by the belt is described below with reference to FIG. 3 that is a fragmentary section view at the print station of a mail-handling machine. It can be noted that, at this level, and more precisely upstream from the print means 16, the mailpieces are jogged against the top referencing wall 30 by the flexible blades that press the mailpiece against said wall. Said blades are inclined to a greater or to a lesser extent, and thus are tensioned to a greater or to a lesser extent, depending on the thickness of the mailpiece, and since the friction forces existing between said blades and the mailpiece are greater than the friction forces existing between the mailpiece and the metal referencing wall, the mailpiece can then be driven without slipping.

Naturally, it can be observed that, although in the preceding description, reference is made essentially to mailpieces, the invention is also applicable to conveying any flat articles, paper, newspapers or magazines or the like providing the weight of the articles does not cause the flexible blades to be crushed, which would make them lose their vertical jogging function.

What is claimed is:

1. A machine for handling flat articles, which machine has a longitudinal referencing wall, wherein said machine is provided with a conveyor and jogger belt formed of a continuous strip having two opposite faces, namely an inside face provided with a set of teeth suitable for co-operating with drive cogs for driving said belt, and an outside face provided with a plurality of flexible blades spaced apart at a predetermined distance, the free ends of said flexible blades providing supports for said flat articles while they are being conveyed, wherein said flexible blades are inclined at a determined angle θ so as also to log said flat articles against said longitudinal referencing wall.

2. A machine for handling flat articles according to claim 1, further having a top referencing wall, wherein said free ends of said flexible blades also jog said flat articles against said top referencing wall.

3. A machine for handling flat articles according to claim 1, wherein a footprint of said inclined flexible blade on said belt is no greater than the width of a tooth of said set of teeth.

4. A machine for handling flat articles according to claim 1, wherein said belt is made integrally of a single material.

5. A machine for handling flat articles according to claim 4, wherein said single material is rubber or silicone.

6. A machine for handling flat articles according to claim 1, wherein said belt is made up of two portions, said continuous strip that is provided with the set of teeth being made of a first material and said flexible blades being made of a second material that is different from the first material.

7. A machine for handling flat articles according to claim 6, wherein said flexible blades are spaced apart by a determined distance making it possible for at least three of said free ends to be in contact with each of said flat articles.

8. A machine for handling flat articles according to claim 6, wherein said second material is a material satisfying the technical specifications for conveying said flat articles.

9. A machine for handling flat articles according to claim 6, wherein said first material is rubber or silicone, and said second material is polyurethane.

10. A machine for handling flat articles according to claim 6, wherein said flexible blades are fastened to the outside face of said continuous strip whose inside face is provided with said set of teeth by an adhesive or by any fastening means appropriate for the types of the materials used.

11. A machine for handling flat articles according to claim 1, wherein each of said flexible blades is mounted in register with a tooth of said set of teeth.

12. A machine for handling flat articles according to claim 1, wherein said flat articles are mailpieces.

* * * * *